US009583897B2

(12) United States Patent
Fargo

(10) Patent No.: US 9,583,897 B2
(45) Date of Patent: Feb. 28, 2017

(54) ELECTRICAL CONNECTION SYSTEM WITH ANNULAR CONTACT

(71) Applicant: S&C Electric Company, Chigaco, IL (US)

(72) Inventor: James Fargo, Winnetka, IL (US)

(73) Assignee: S&C ELECTRIC COMPANY, Chicago, IL (US)

( * ) Notice: Subject to any disclaimer, the term of this patent is extended or adjusted under 35 U.S.C. 154(b) by 75 days.

(21) Appl. No.: 14/683,205

(22) Filed: Apr. 10, 2015

(65) Prior Publication Data

US 2015/0295367 A1 Oct. 15, 2015

Related U.S. Application Data

(60) Provisional application No. 61/978,019, filed on Apr. 10, 2014.

(51) Int. Cl.

| | |
|---|---|
| ***H01R 24/38*** | (2011.01) |
| ***H01R 13/62*** | (2006.01) |
| ***H01R 13/24*** | (2006.01) |
| *H01R 39/00* | (2006.01) |
| *H01R 11/30* | (2006.01) |
| *H01R 103/00* | (2006.01) |
| *H01R 13/33* | (2006.01) |

(52) U.S. Cl.

CPC ..... *H01R 24/38* (2013.01); *H01R 13/2407* (2013.01); *H01R 13/6205* (2013.01); *H01R 11/30* (2013.01); *H01R 13/33* (2013.01); *H01R 39/00* (2013.01); *H01R 2103/00* (2013.01)

(58) Field of Classification Search

CPC ..... H01R 39/00; H01R 11/30
USPC ..... 439/39, 21, 25, 38
See application file for complete search history.

(56) References Cited

U.S. PATENT DOCUMENTS

| | | | | |
|---|---|---|---|---|
| 3,521,216 | A | 7/1970 | Tolegian | |
| 6,227,892 | B1 | 5/2001 | Kera | |
| 7,946,892 | B2 | 5/2011 | Carboni et al. | |
| 8,323,058 | B2 * | 12/2012 | Flaherty | H01R 13/6277 439/680 |

(Continued)

OTHER PUBLICATIONS

United States International Searching Authority, International Search Report and Written Opinion for International Application No. PCT/US2015/025253 mailed Jul. 9, 2015.

*Primary Examiner* — Abdullah Riyami
*Assistant Examiner* — Justin Kratt
(74) *Attorney, Agent, or Firm* — Lorenz & Kopf LLP

(57) ABSTRACT

An electrical connector system includes a socket component and a plug component. The socket component includes a contact region, a first socket contact centrally located within the circular contact region, and a second socket contact radially offset from the first socket contact by a first distance. The plug component includes a plug having a plug face, a first plug contact centrally located substantially within the circular plug face, and an annular, elastically deformable conductor having a radius approximately equal to the first distance which functions as a second plug contact. The socket contact region is configured to mate with the plug face to provide electrical continuity, in a connected state, between the first socket contact and the first plug contact, and to provide electrical continuity between the second socket contact and the second plug contact.

20 Claims, 5 Drawing Sheets

(56) References Cited

U.S. PATENT DOCUMENTS

| | | | | |
|---|---|---|---|---|
| 8,696,366 | B2 * | 4/2014 | Chen | H01R 13/6205 439/39 |
| 9,088,097 | B2 * | 7/2015 | Kim | H01R 13/6205 |
| 2006/0252307 | A1 | 11/2006 | Koenig et al. | |
| 2008/0214040 | A1 | 9/2008 | Holterhoff et al. | |
| 2010/0248521 | A1 | 9/2010 | Lin et al. | |
| 2014/0099801 | A1 * | 4/2014 | Liao | H01R 13/6205 439/39 |

* cited by examiner

ELECTRICAL CONNECTION SYSTEM WITH ANNULAR CONTACT

CROSS-REFERENCE TO RELATED APPLICATIONS

This application claims the benefit of U.S. Provisional Application No. 61/978,019 filed on Apr. 10, 2014, the entire disclosure of which is incorporated herein by reference.

TECHNICAL FIELD

The technical field generally relates to electrical interconnects, and more particularly relates to electrical connection systems capable of accommodating variations in plug and/or socket orientations.

BACKGROUND

Connections between the various components of a power distribution system and other such electrical systems are affected using a wide range of plugs, sockets, and the like. In many cases, the operator has easy access to the interconnect components, but in other cases, access to these components are relatively limited. This is particularly the case in high-power distribution systems application where electrical components may be installed at great heights or other hard-to-reach areas.

In many cases, plugs are designed to connect with their respective sockets in a very specific relative orientation. In addition, such plug-and-socket arrangements may require that a significant insertion force be applied to the socket during connection. This can be a disadvantage in cases where the socket is relatively inaccessible and "blind" insertion of the plug is desirable. Furthermore, in outdoor applications, sockets which are subject to extreme environmental conditions may require sealing from the weather to protect the enclosed components.

Accordingly, there is a need for improved electrical connection systems for the above-described circumstances. Other desirable features and characteristics of the present invention will become apparent from the subsequent detailed description and the appended claims, taken in conjunction with the accompanying drawings and the foregoing technical field and background.

DESCRIPTION OF THE DRAWINGS

The exemplary embodiments will hereinafter be described in conjunction with the following drawing figures, wherein like numerals denote like elements.

DETAILED DESCRIPTION

Figure 1:
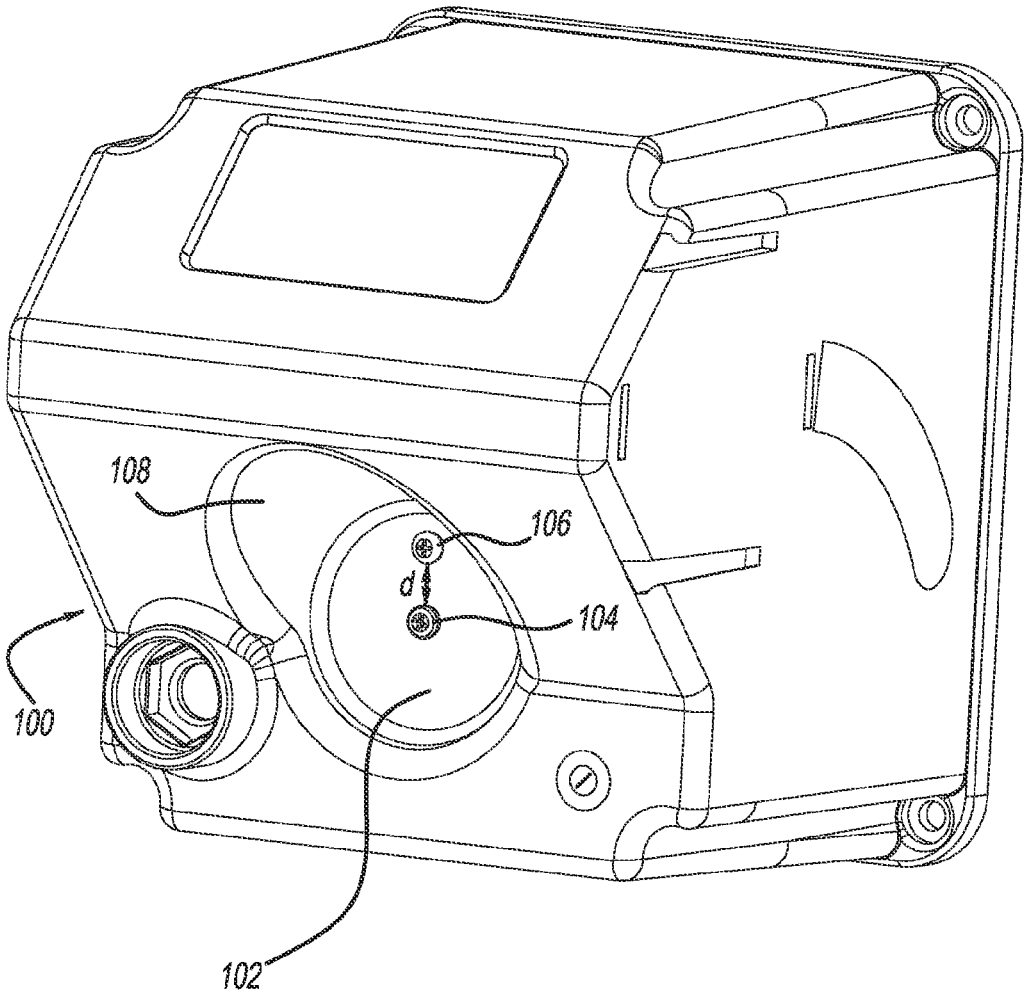
FIG. 1 is an isometric overview of a socket component in accordance with one embodiment.

An electrical connector system in accordance with one embodiment includes a socket component and a plug component. The socket component includes a circular contact region, a first socket contact located substantially at the center of the circular contact region, and a second socket contact radially offset from the first socket contact by a first distance. The plug component includes a circular plug face, a first plug contact located substantially at the center of the circular plug face, and a second plug contact comprising an annular, elastically deformable conductor supported in an insulated cup of a plug housing. The annular, elastically deformable conductor having a radius approximately equal to the first distance. The circular contact region of the socket component is configured to mate with the circular plug face of the plug component to provide electrical continuity, in a connected state, between the first socket contact and the first plug contact, and to provide electrical continuity between the second socket contact and the second plug contact.

In accordance with another embodiment, a plug component is configured to mate with a socket component having a central socket contact and a radially offset second contact. The plug component includes a substantially cylindrical housing, a circular plug face provided at a first end of the substantially cylindrical housing, and a first plug contact located substantially at the center of the circular plug face and a second plug contact comprising an annular, elastically deformable conductor supported in an insulated cup of the cylindrical housing. The radius of the second plug contact is approximately equal to a distance between the central socket contact and the radially offset second contact.

In accordance with another embodiment, a socket component is configured to mate with a plug component having a central first plug contact and an annular second plug contact having a predetermined radius. The socket component includes a circular contact region, a first socket contact located substantially at the center of the circular contact region, and a second socket contact radially offset from the first socket contact by a distance substantially equal to the predetermined radius.

The subject matter described herein generally relates to an improved electrical connection system in which the corresponding plug and socket components can accommodate variation in orientation, there is no intention to be bound by any expressed or implied principle presented in the preceding technical field, background or the following detailed description. Furthermore, it will be understood that the drawing figures are not necessarily drawn to scale and may be referred to herein, without loss of generality, as "isometric" (as opposed to "perspective") drawings even when such drawings are not strictly isometric, but are otherwise axonometric as is known in the art.

FIG. 1 is an isometric overview of a socket component (or simply "socket") 100 in accordance with one embodiment. In general, socket 100 includes a generally circular contact region (or simply "contact region") 102 and two socket contacts: a first socket contact (or simply "contact") 104 located substantially at the center of the circular contact region 102, and a second socket contact (or simply "contact") 106 radially offset from first socket contact 104 by a distance d. Contacts 104 and 106 may be implemented as a variety of conductive structures, such as pins, rivets, or conventional screw heads (as shown), and will generally extend from contact region 102 by a predetermined distance. In one embodiment, for example, contacts 104 and 106 are screw heads that extend outward from contact region 102 by about 0.05" to 0.07".

In some embodiments, socket 100 includes a beveled wall region 108 surrounding at least a portion of circular contact region 102 to help guide the plug component (described below) as it is being connected to socket 100. That is, beveled wall region 108 facilitates "blind" connection to socket 100. In the illustrated embodiment, beveled wall region surrounds approximately half of contact region 102 and resembles a partial conic section extending and expanding outward therefrom. It will be appreciated that the invention is not so limited, however, and that the size and shape of wall region 108 may vary depending upon a number of factors, including the relative accessibility and orientation of socket 100 in the field.

Figure 2:
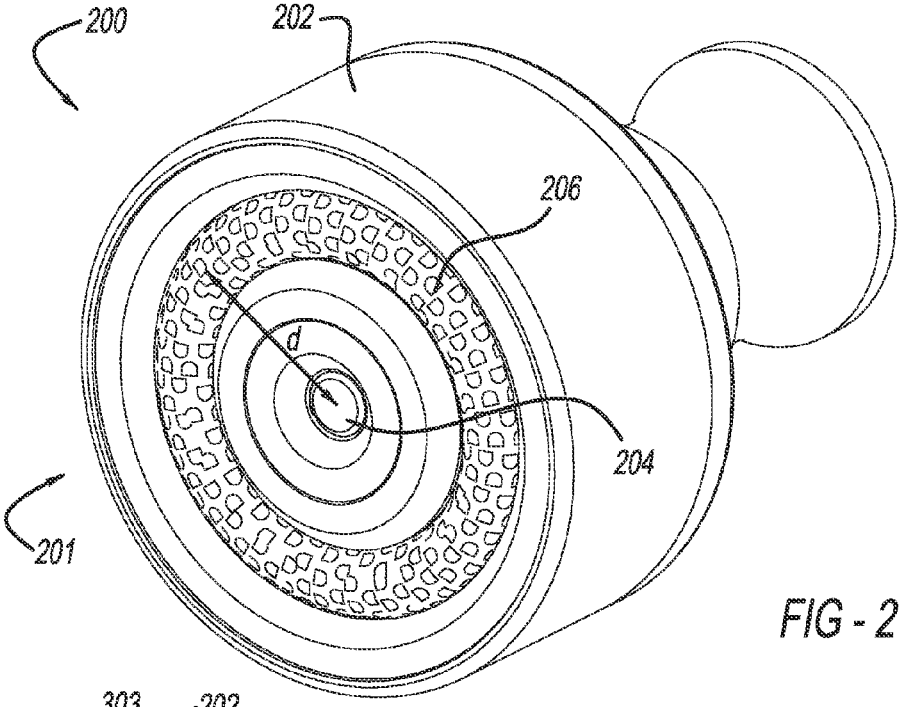
FIG. 2 is an isometric overview of an exemplary plug component configured to connect to the socket component illustrated in FIG. 1.

Referring now to FIG. 2 in conjunction with FIG. 1, an exemplary plug component (or simply "plug") 200 is configured to connect to (e.g., provide electrical connectivity with) socket component 100. Accordingly, plug component 200 includes a generally cylindrical outer housing 202 and a circular plug face (or simply "plug face") 201 that substantially matches, in size and shape, circular contact region 102 of socket 100. Plug component 200 includes a central plug contact 204 located substantially at the center of circular plug face 201, and a second plug contact 206. In accordance with various embodiments, plug contact 206 is an annular, elastically deformable conductor having a radius approximately equal to distance d of socket 100. In this way, contact region 102 of socket 100 is configured to mate with the plug face 201 of plug 200 to provide electrical continuity, in a connected state, between the two centrally-located contacts, namely contact 104 of socket 100 and contact 204 of plug 200, while at the same time providing electrical continuity between offset contact 106 of socket 100 and annular contact 206 of plug 200. It will be appreciated that, due to the annular or ring-like shape of contact 206 and its ability to elastically deform (described in further detail below), plug 200 is capable of reliably and repeatedly connecting to socket 100 regardless of orientation (e.g., around an axis through contact 204 and perpendicular to plug face 201).

Figure 3:
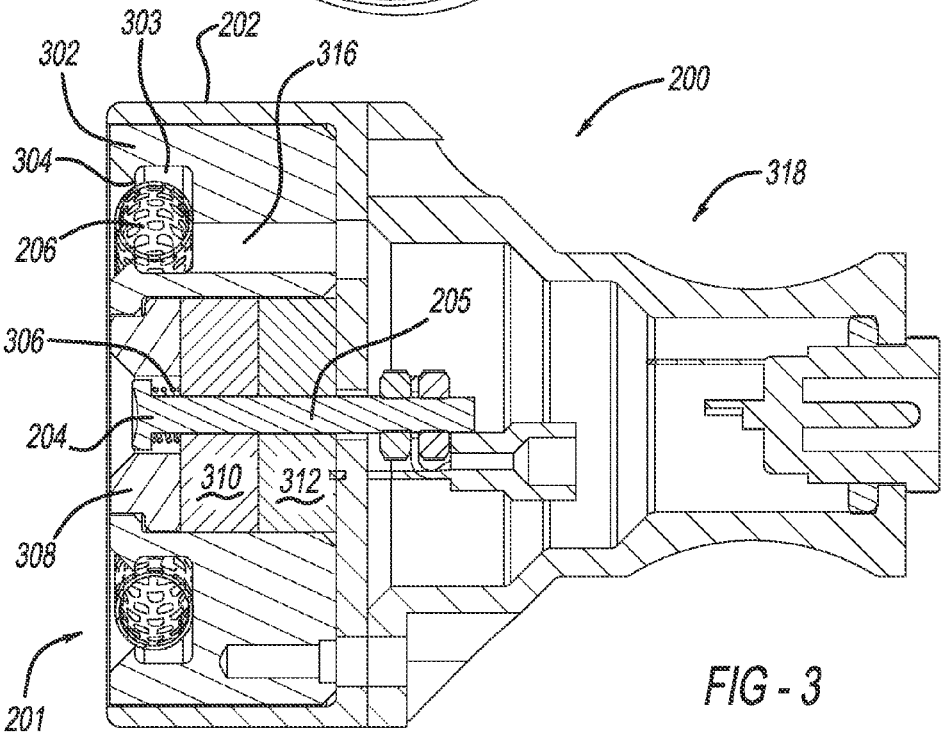
FIG. 3 is cross-sectional view of the plug component illustrated in FIG. 2.

FIG. 3 is cross-sectional view of the plug component illustrated in FIG. 2. Plug 200 comprises an insulated retainer component or cup 302 having an annular cavity 303 formed therein. As shown, annular cavity 303 is configured to receive and releasably retain (e.g., via annular retaining structures 304) annular contact 206. In addition, an internal pathway 316 may be provided to allow electrical connectivity with contact 206 (e.g., via a wire or other interconnect, not illustrated in this figure).

Figure 4:
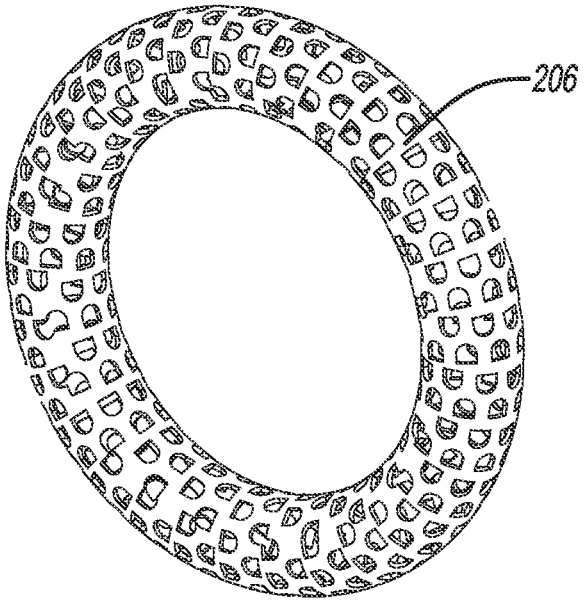
FIG. 4 is an isometric view of an exemplary annular contact element.
Figure 5:
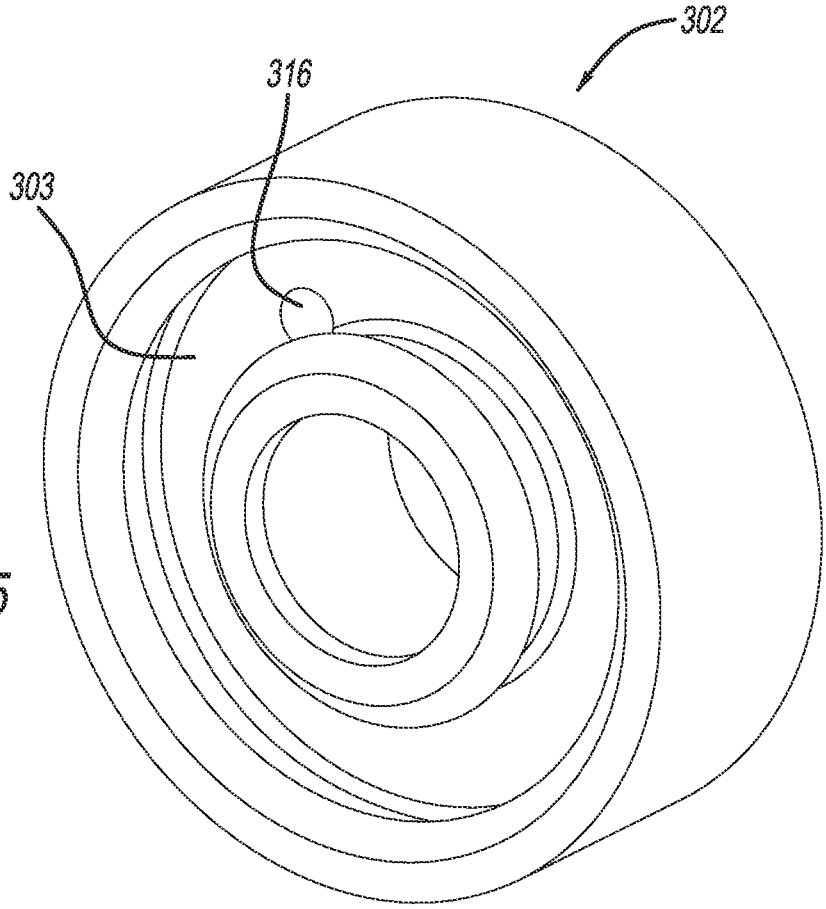
FIG. 5 is an isometric view of an exemplary retainer cup configured to accept an annular contact element as illustrated in FIG. 4.

Referring momentarily to FIGS. 4 and 5, FIG. 4 is an isometric view of an exemplary annular contact component 206, and FIG. 5 is an isometric view of an exemplary retainer cup 302 configured to accept annular contact 206. FIG. 5 also depicts annular cavity 303 and internal pathway 316 in accordance with a particular embodiment. Retainer cup 302 may be formed from a variety of insulating or dielectric materials, including a wide range of plastics. In a particular embodiment, for example, retainer cup 302 is a highly-crystalline polymer such as DuPont™ Delrin®.

Figure 7:
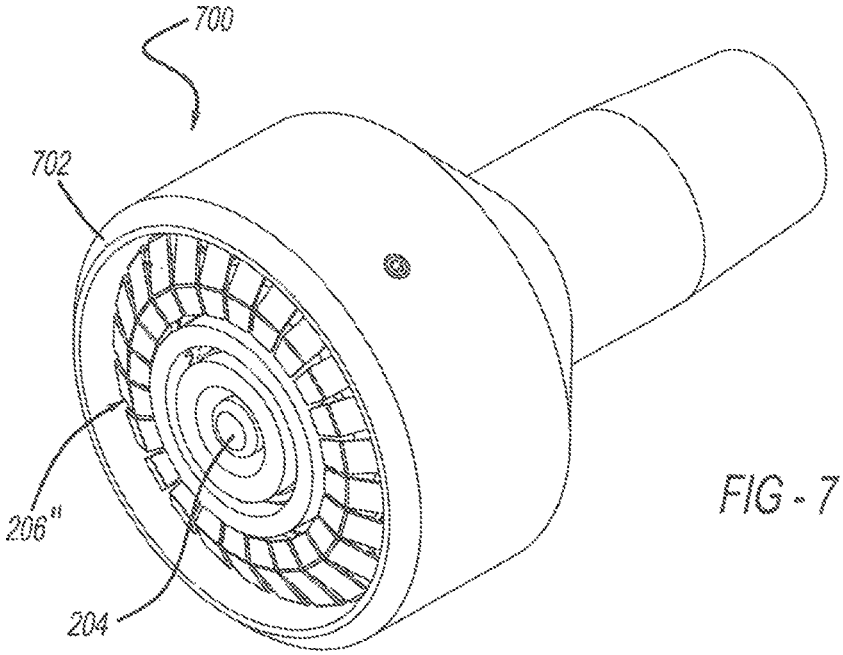
FIG. 7 is an isometric overview of an alternate plug component.
Figure 8:
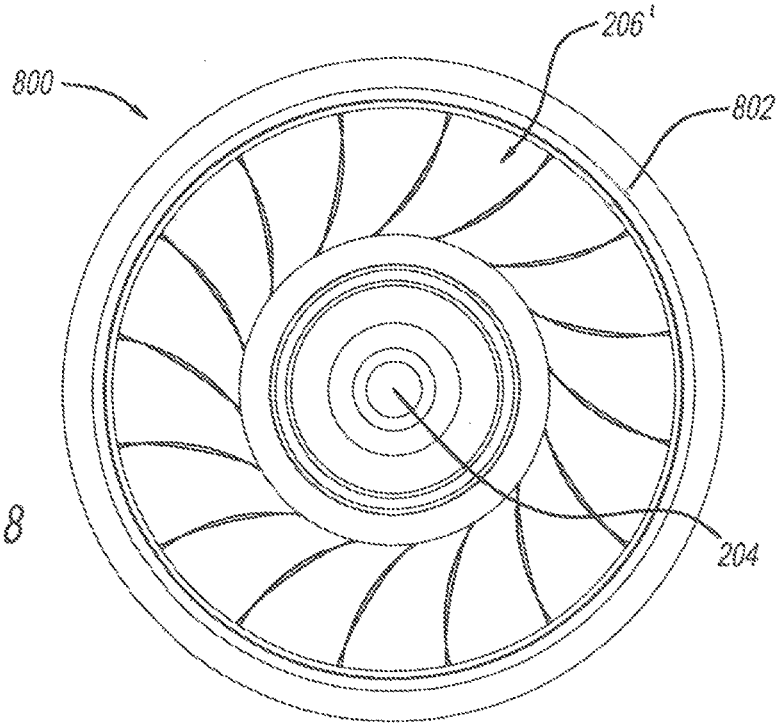
FIG. 8 is a plan view of a plug component similar to that shown in FIGS. 1-6 but having an alternate annular contact element.

Annular contact 206 may be implemented using a variety of structures, shapes, and materials. In one embodiment, as shown in FIG. 4, annular contact 206 is a toroidal (i.e., "donut shaped") conductive element. Annular contact 206 may be substantially hollow, or may substantially fill annular cavity 303 with conductive material. In a particular embodiment, contact 206 is fabricated as a ring of woven conductive material, such as EMI-shielding copper or some other suitable metal. Such embodiments are advantageous as they provide repeatable and relatively constant elastic deformation (with very little plastic deformation over time). In another embodiment as best seen in FIG. 8, plug component 800 includes a generally cylindrical outer housing 802 and a contact 206' implemented as a spiral ribbon of metal (e.g., copper, copper-coated or aluminum-coated) formed into a toroidal shape. In yet another embodiment as best seen in FIG. 7, plug component 700 includes a generally cylindrical outer housing 702 and a contact 206" implemented as a series of metallic "teeth" formed as a ring and configured to independently and elastically deflect during connection. In a particular embodiment, annular contact 206 is configured to elastically deform approximately 0.05" to 0.07" in the connected state (e.g., approximately the distance that contacts 104 and 106 extend from circular socket region 102 of FIG. 1). It will be appreciated that the invention is not so limited, however.

Referring again to FIG. 3, one or more magnetic elements may be incorporated into plug 200 to provide a holding force (resisting axial and rotational movement) between plug 200 and socket 100 of FIG. 1. For example, as illustrated, plug 200 includes two magnetic elements 310 and 312, which are generally annular and coaxial with respect to a central pin 205 whose end forms contact 204. A variety of permanent magnets may be employed, including relatively powerful rare-earth magnets such as neodymium magnets as are known in the art. A metallic magnetic "concentrator" 308 may also be provided between plug face 201, as shown for focusing the magnet fields of magnets 310, 312.

As shown, a spring element 306 may be provided between contact 204 and some other internal structure (such as magnet 310) to allow a small "stroke" or axial movement of connector 204. Spring element 306 thus assists in providing reliable electrical connection between contact 204 and the corresponding contact (104) of socket 100.

Plug 200 may include an end 318 configured to interface with one or more other interconnects, such as a variety of commonly-used socket-and-plug schemes. That is, end 318 may be configured to interface with a standard socket types (e.g., a 2.1 mm DC socket) such that the advantages described herein may be used in a wide variety of interconnect contexts.

Figure 6:
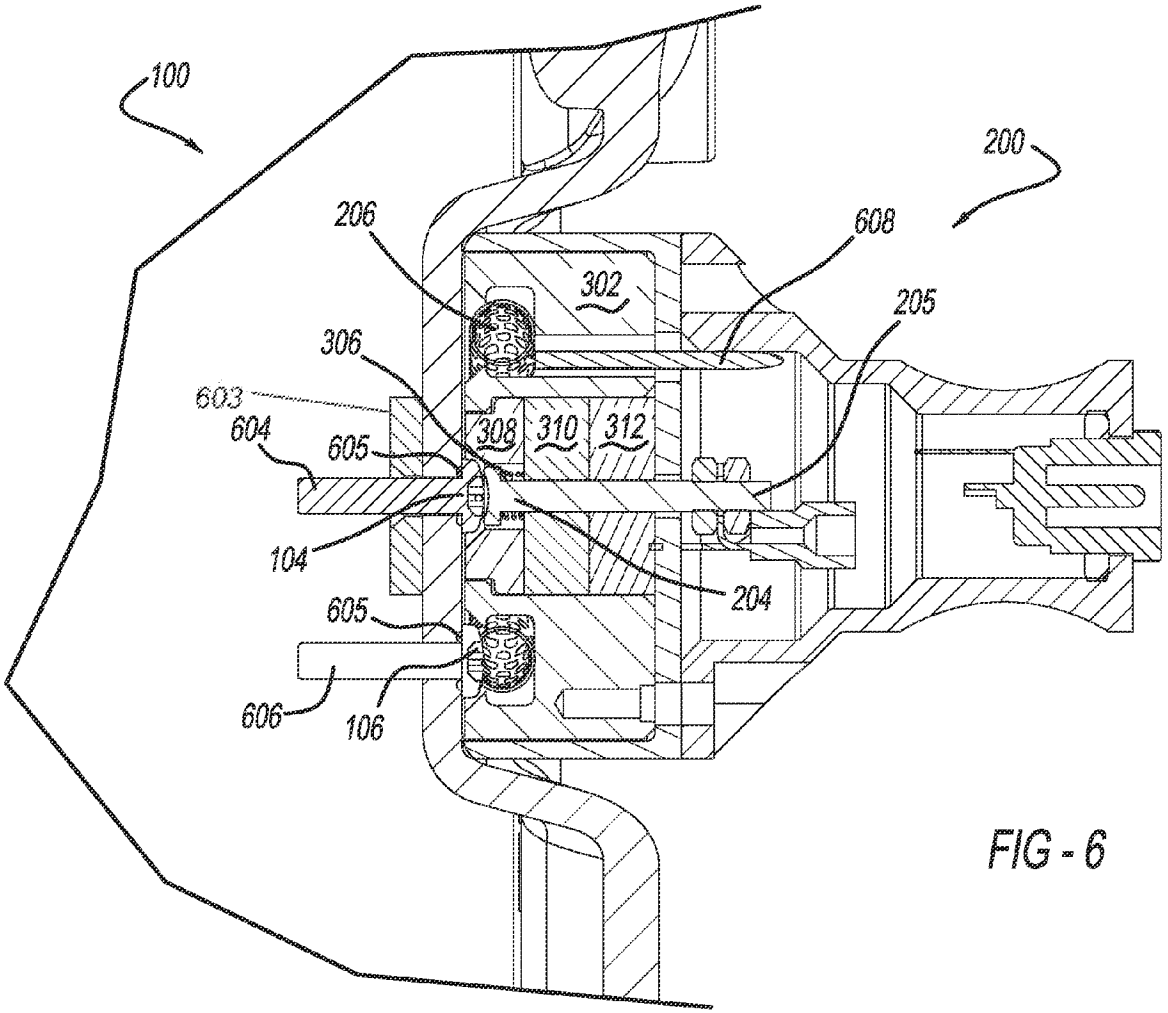
FIG. 6 is a cross-sectional view of a plug component connected to a socket component in accordance with one embodiment.

FIG. 6 is a cross-sectional view of plug 200 connected to socket 100 in accordance with one embodiment. In this embodiment, socket 100 itself includes a magnetic element 603 that is configured to interact with magnetic elements 310 and 312 (through concentrator 308) to thereby provide the compressive force that holds plug 200 secure axially and rotationally with respect to socket 100. Side-to-side movement of plug 200 is prevented due to generally recessed contact region (e.g., corresponding to contact region 102 of FIG. 1) of socket 100 as shown.

As can be seen, by virtue of spring 306 and pin 205, contact 204 has been recessed slightly, providing compressive contact force between corresponding contacts 204 and 604. At the same time, annular contact 206 is slightly elastically deformed to provide connectivity with contact 106. As shown, socket 100 includes two pins, screws, bolts, or other conductive components 604 and 606 which, on one end, are electrically continuous with contacts 104 and 106, respectively. Sealing components (e.g., elastomeric washers) 605 may be used in connection with pins 604 and 606 as shown to provide a more water-tight or otherwise weather-resistant socket 100 for use in outdoor or underground applications. As will be appreciated, components 604 and 606 may be electrically coupled to various other internal and external components through wires or other interconnects (not illustrated). FIG. 6 also depicts an interconnect (e.g., a wire element) 608 coupled to annular contact 206.

While at least one exemplary embodiment has been presented in the foregoing detailed description, it should be appreciated that a vast number of variations exist. It should also be appreciated that the exemplary embodiment or exemplary embodiments are only examples, and are not intended to be models or otherwise limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof. For example, the socket and plug components have been shown and described as having a circular configuration. While a circular configuration provides the greatest degree of freedom when interconnecting these components, one skilled in the art will appreciate that the socket and plug components have other configurations.

What is claimed is:

1. An electrical connector system comprising:

a socket component including a circular contact region, a first socket contact centrally located within the circular contact region, and a second socket contact radially offset from the first socket contact by a first distance; and a plug component including a circular plug face, a first plug contact centrally located substantially within the circular plug face, and a second plug contact comprising an annular, elastically deformable conductor having a radius approximately equal to the first distance;

wherein the contact region of the socket component is configured to mate with the plug face of the socket component to provide electrical continuity, in a connected state, between the first socket contact and the first plug contact, and to provide electrical continuity between the second socket contact and the second plug contact.

2. The electrical connector system of claim 1, wherein the plug component includes a first magnetic element configured to provide a holding force between the socket component and the plug component in the connected state.

3. The electrical connector system of claim 2, wherein the socket component includes a second magnetic element configured to interact with the first magnetic element to provide the holding force between the socket component and the plug component in the connected state.

4. The electrical connector system of claim 3, wherein the first magnetic element and second magnetic element are annular permanent magnets positioned substantially coaxially.

5. The electrical connector system of claim 1, wherein the second plug contact comprises a toroidal conductive element.

6. The electrical connector system of claim 1, wherein the second plug contact comprises a ring of woven conductive material.

7. The electrical connector system of claim 1, wherein the plug component comprises an insulated retainer component having an annular cavity formed therein, the annular cavity configured to receive and releasably retain the second plug contact.

8. The electrical connector system of claim 1, wherein the second plug contact is configured to elastically deform into the annular cavity a distance approximately 0.05" to 0.07" in the connected state.

9. The electrical connector system of claim 1, wherein the first plug contact includes a conductive pin and a spring element coupled thereto to accommodate the first socket contact in the connected state.

10. The electrical connector system of claim 1, wherein the socket component includes a first sealing element between the first socket contact and a surface of the contact region, and a second sealing element between the second socket contact and the surface of the contact region.

11. The electrical connector system of claim 1, wherein the socket component further includes a beveled wall region surrounding at least a portion of the contact region.

12. A plug component configured to mate with a socket component having a central socket contact and a radially offset second contact, the plug component comprising:

a substantially cylindrical housing;

a circular plug face provided at a first end of the substantially cylindrical housing;

a first plug contact centrally located within the circular plug face; and a second plug contact including an annular, elastically deformable conductor, wherein the radius of the second plug contact is approximately equal to a distance between the central socket contact and the radially offset second contact.

13. The plug component of claim 12, further including an insulated retainer component configured to coaxially seat within the substantially cylindrical housing and having an annular cavity formed therein to receive and releasably retain the second plug contact.

14. The plug component of claim 12, further including at least one magnetic element configured to provide a holding force between the plug component and a socket component.

15. The plug component of claim 12, wherein the first plug contact includes a conductive pin and a spring element coupled thereto to accommodate the central socket contact.

16. The plug component of claim 12, wherein the second plug contact comprises a toroidal conductive element.

17. The plug component of claim 12, wherein the second plug contact comprises a ring of woven conductive material.

18. A socket component in combination with the plug component of claim 12, the socket component configured to mate with the plug component and further comprising:

a circular contact region;

a first socket contact centrally located within the circular contact region; and a second socket contact radially offset from the first socket contact by a distance substantially equal to the predetermined radius.

19. The socket component of claim 18, further including a first sealing element between the first socket contact and the circular contact region, and a second sealing element between the circular contact region and the second socket contact.

20. The socket component of claim 18, further including a beveled wall region surrounding at least a portion of the circular contact region to guide the plug component during connection to circular contact region.

* * * * *